US007262708B1

(12) United States Patent
Addicks

(10) Patent No.: US 7,262,708 B1
(45) Date of Patent: Aug. 28, 2007

(54) FUELING STATION ELECTRONIC PRICING SIGN

(76) Inventor: Lyle Addicks, 6006 E. Shull St., Bell Gardens, CA (US) 90201

( * ) Notice: Subject to any disclaimer, the term of this patent is extended or adjusted under 35 U.S.C. 154(b) by 215 days.

(21) Appl. No.: 10/970,235

(22) Filed: Oct. 22, 2004

(51) Int. Cl.
*G08B 5/22* (2006.01)

(52) U.S. Cl. ..... 340/815.63; 40/576; 362/800

(58) Field of Classification Search ..... 340/815.45, 340/815.33, 815.63; 345/39, 30, 33, 46, 345/55, 1.1; 40/447, 452, 451, 540–541, 40/576; 362/368, 362, 373, 800
See application file for complete search history.

(56) References Cited

U.S. PATENT DOCUMENTS 5,315,775 A * 5/1994 Parker et al. ..... 40/450
5,778,577 A * 7/1998 Bailey ..... 40/450
5,870,110 A * 2/1999 Mallory ..... 345/168
5,896,688 A * 4/1999 Aiken et al. ..... 40/519
6,212,806 B1 * 4/2001 Krawinkel ..... 40/450
6,533,444 B2 * 3/2003 Lee ..... 362/540
6,883,945 B1 * 4/2005 Gonzalez ..... 362/485
2004/0189218 A1 * 9/2004 Leong et al. ..... 315/291
2005/0246927 A1 * 11/2005 Krawinkel ..... 40/544

* cited by examiner

*Primary Examiner*—Brent A. Swarthout
(74) *Attorney, Agent, or Firm*—Kenneth L. Green; Edgar W. Averill, Jr.

(57) ABSTRACT

Single digit Light Emitting Diode (LED) modules for replacing plastic numerals in a gas station pricing sign. Three or four LED modules represent one fuel price. The LED modules are mounted to a transparent face present on existing signs, and may be mounted on an exterior or interior surface of the face. In one embodiment, first LED modules mechanically cooperate with backing plates, thereby sandwiching the face, in another embodiment, second LED modules attach to posts glued to the face. When mounted externally, the LED modules fit into tracks provided for the plastic numerals which are being replaced. An RF, infrared, or hard wired control signal may be used to change prices, and a photocell may be used to control LED intensity in response to ambient light. Additional low power consumption LEDs are provided inside the sign to back illuminate information provided on the face.

18 Claims, 16 Drawing Sheets

FUELING STATION ELECTRONIC PRICING SIGN

BACKGROUND OF THE INVENTION

The present invention relates to signs for exhibiting prices at gasoline stations, and more particularly to single digit electronic sign elements suitable for using with existing signs.

During a business day, events may motivate one or more price changes at gasoline stations. For example, fuel costs may change or a competitor may change prices. The station operator may observe that sales are low due to too high of a price, or that long lines are developing at pumps are due to too low of a price. Additionally, station operators may wish to adjust prices at predetermined times during the day based on predictable changes in demand. For example, some stations are contractually obligated to remain open 24 hours of the day. Lower prices may add to sales (and thus profits) outside commuting hours, and both operating cost and market prices may increase between late night and early morning hours.

Gasoline stations are often operated by a single individual responsible for a variety of tasks including receiving payments for fuel and other purchases, resolving any problems that might arise, monitoring activity around the station, and adjusting fuel prices. Generally, gasoline stations are required to post fuel prices which are in agreement with actual prices on gasoline pumps. Although changing actual prices on the pumps may be fairly easy, changing prices on signs may be difficult and time consuming. Because the operator does not have time available to manually changes prices on signs posted for passing motorists, the station operator is not free to make desired price changes on the pumps. As a result, profits are reduced.

Known gasoline station signs use replaceable numerals comprising rectangular transparent plastic sheets bearing numerals, which replaceable numerals are changed to reflect new fuel prices. The replaceable plastic numerals reside over a transparent window (or face) which passes light radiated from light sources inside the sign. Generally, the replaceable plastic numerals slide into tracks or holders on the faces. Because of the expense of replacing the entire gasoline station sign, there is a need for an apparatus and method for replacing existing replaceable numerals with controllable electronic numerals.

Some replacement Light Emitting Diode (LED) numerals have been proposed, which numerals comprise a single LED panel displaying a three or four digit price of fuel. Unfortunately, such panels are heavy and are not effectively adaptable to signs with curved fronts. The large multi-digit panels may not match the curvature of sign fronts, and thus are not suitable for mounting outside the face, and when the large multi-digit panels are mounted inside the face, a gap between the curved face and the flat panel results in defusion of light and thus blurring of the prices.

Known sign faces are generally acrylic or poly carbonate. The acrylic faces are most common, and may crack if holes are drilled to mount LED panels. The poly carbonate faces may be drilled but are less frequent.

What is needed is a method and apparatus for replacing the existing plastic numerals with individual single digit LED modules, which method preferably does not require drilling mounting holes in acrylic faces of signs.

BRIEF SUMMARY OF THE INVENTION

The present invention addresses the above and other needs by providing single digit Light Emitting Diode (LED) modules for replacing plastic numerals in a gas station pricing sign. Three or four single digit LED modules represent one fuel price. The LED modules are mounted to a transparent face present on existing signs, and may be mounted on an exterior or interior surface of the face.

In one embodiment, first LED modules mechanically cooperate with backing plates, thereby sandwiching the face, in another embodiment, second LED modules attach to posts glued to the face. When mounted externally, the LED modules fit into tracks provided for the plastic numerals which are being replaced. An RF, infrared, or hard wired control signal may be used to change prices, and a photocell may be used to control LED intensity in response to ambient light. Additional low power consumption LEDs are provided inside the sign to back illuminate information provided on the face.

In accordance with one aspect of the invention, there is provided a pricing sign including LED numerals. The sign comprises at least one sign face and a multiplicity of single digit LED modules. Each LED module has a multiplicity of LEDs, wherein a subset of the LEDs may be energized to represent a selectable one of ten Arabic numerals. The LED modules are mounted to the face in an arrangement allowing representation of a price.

In accordance with another aspect of the invention, there is provided a first method for converting a pricing sign to use single digit LED modules. The first method comprising mounting at least one single digit LED module to the sign, connecting a data cable between a controller and the LED module, and connecting a power cable between a power supply and the LED module. Mounting the LED module to the sign comprising the steps of removing a plastic numeral, drilling mounting holes in a sign face at pre-defined locations, placing the LED module into tracks on an outside surface of the face, positioning a backing plate opposite the LED module against an inside surface of the face, and sandwiching the face between the LED module and the backing plate using fasteners passing through the backing plate, through the face, and into the LED module.

In accordance with yet another aspect of the invention, there is provided a second method for converting a pricing sign to use single digit LED modules. The second method comprises mounting at least one second single digit LED module to a face of the sign, connecting a data cable between a controller and the LED module, and connecting a power cable between a power supply and the LED module. Mounting the second LED module comprises the steps of, removing a plastic number from tracks on the face, gluing enclosure posts to the sign face, placing the second LED module into the tracks, and attaching the LED module to the enclosure posts;

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

FIG: 11A shows a front view of the LED module in cooperation with tracks on the sign face.

Figure 12:
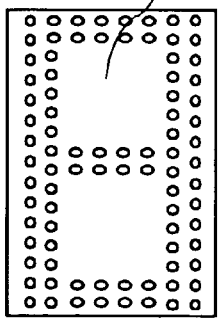

FIG. 12 is a preferred arrangement of LEDs on the LED PCB.

Figure 12A:
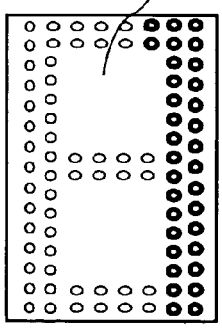

FIG. 12A shows a representation of a "1" using the preferred LED arrangement.

Figure 12K:
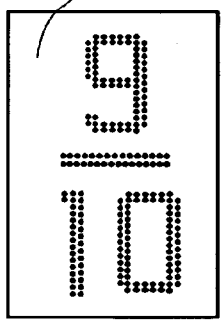
Figure 12B:
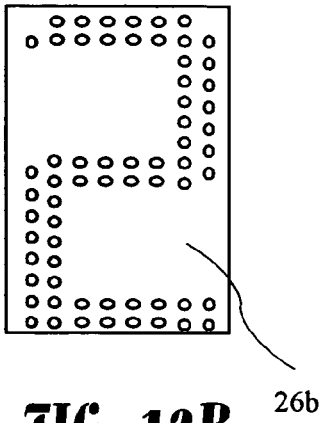

FIG. 12B shows a representation of a "2" using the preferred LED arrangement.

Figure 12C:
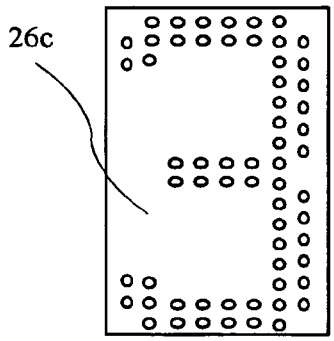

FIG. 12C shows a representation of a "3" using the preferred LED arrangement.

Figure 12D:
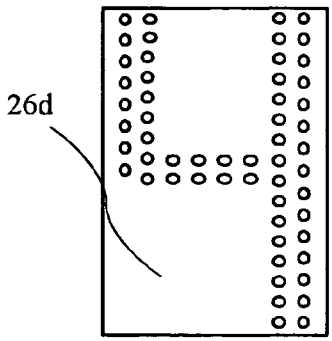

FIG. 12D shows a representation of a "4" using the preferred LED arrangement.

Figure 12E:
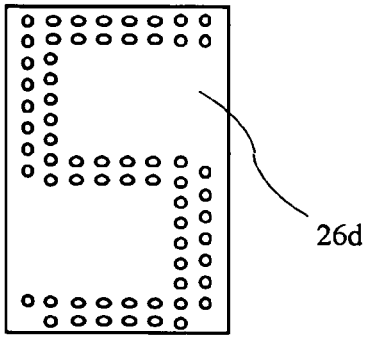

FIG. 12E shows a representation of a "5" using the preferred LED arrangement.

Figure 12F:
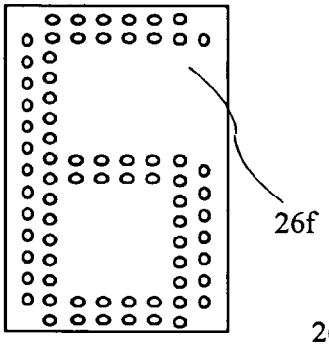

FIG. 12F shows a representation of a "6" using the preferred LED arrangement.

Figure 12G:
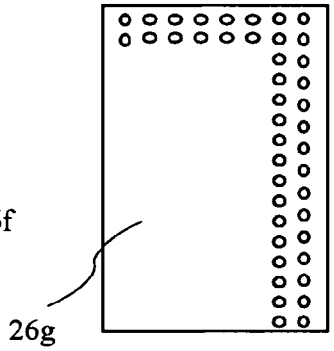

FIG. 12G shows a representation of a "7" using the preferred LED arrangement.

Figure 12H:
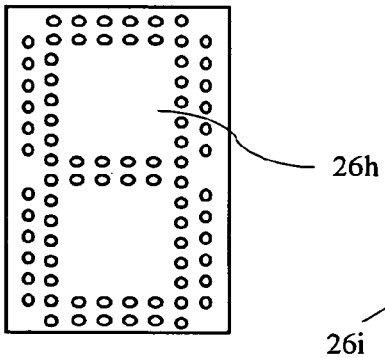

FIG. 12H shows a representation of an "8" using the preferred LED arrangement.

Figure 12I:
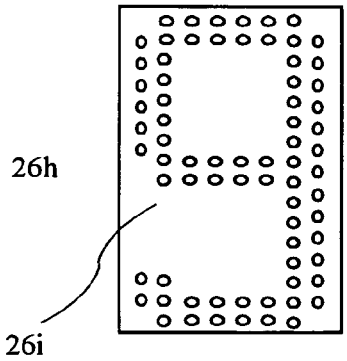

FIG. 12I shows a representation of a "9" using the preferred LED arrangement.

Figure 12J:
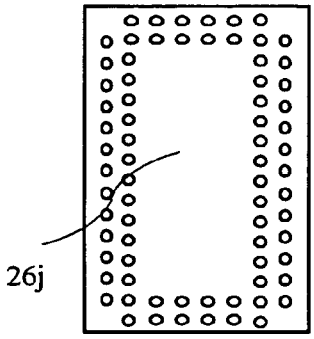

FIG. 12J shows a representation of a "0" using the preferred LED arrangement.

FIG. 12K shows a fractional LED arrangement preferred for representation of a "9/10".

Figure 13:
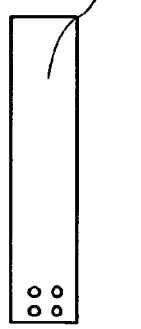

FIG. 13 is an LED representation of a decimal point.

Figure 14:
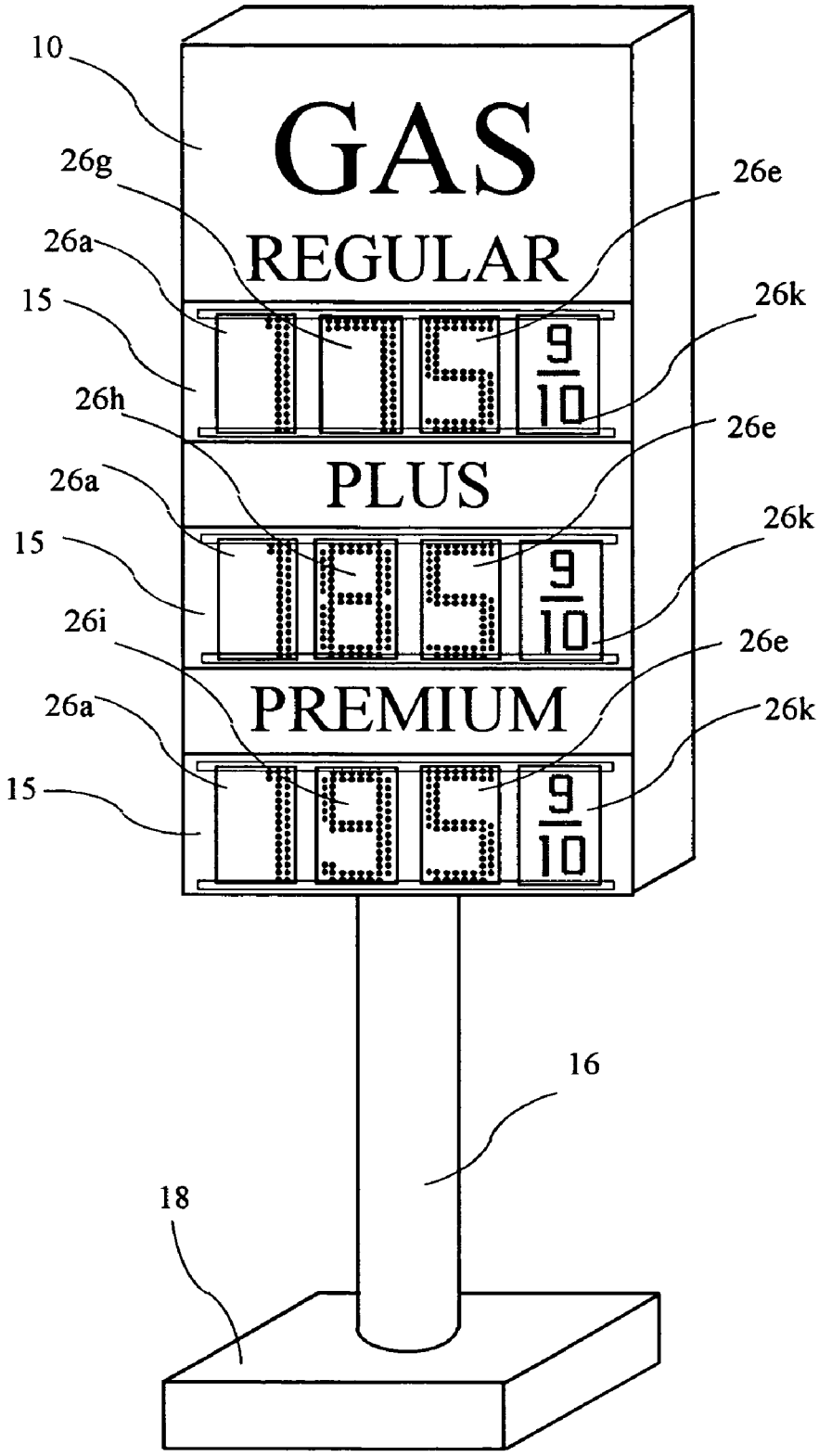

FIG. 14 is a sign having prices represented by LED numerals.

Figure 15A:
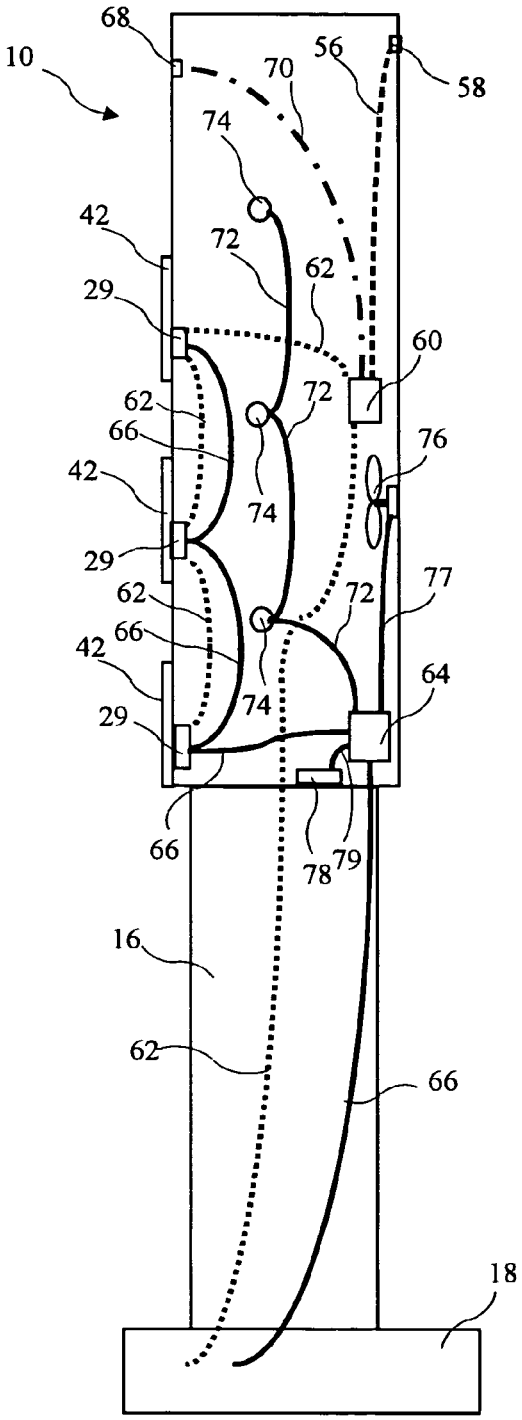

FIG. 15A is an interior view of the sign converted using the first LED modules.

Figure 15B:
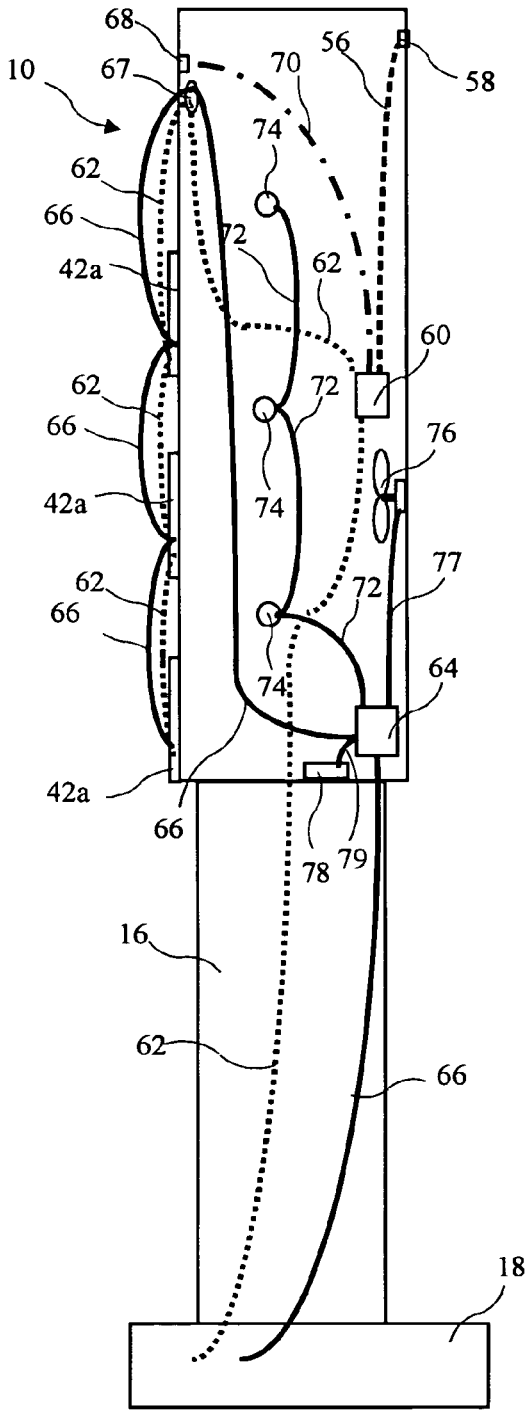

FIG. 15B is an interior view of the sign converted using the second LED modules.

Figure 16:
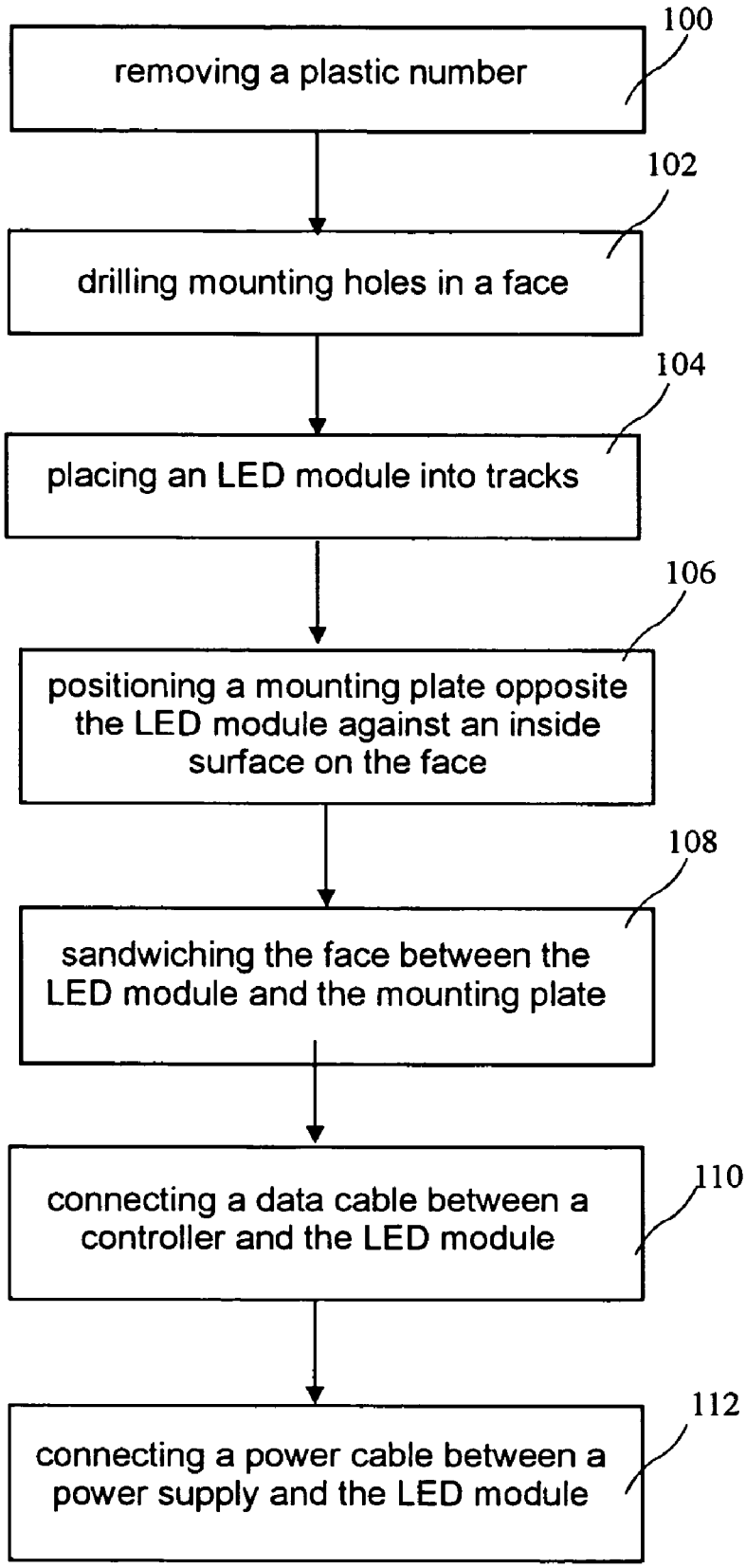

FIG. 16 is a first method for converting a known sign to an LED module sign.

Figure 17:
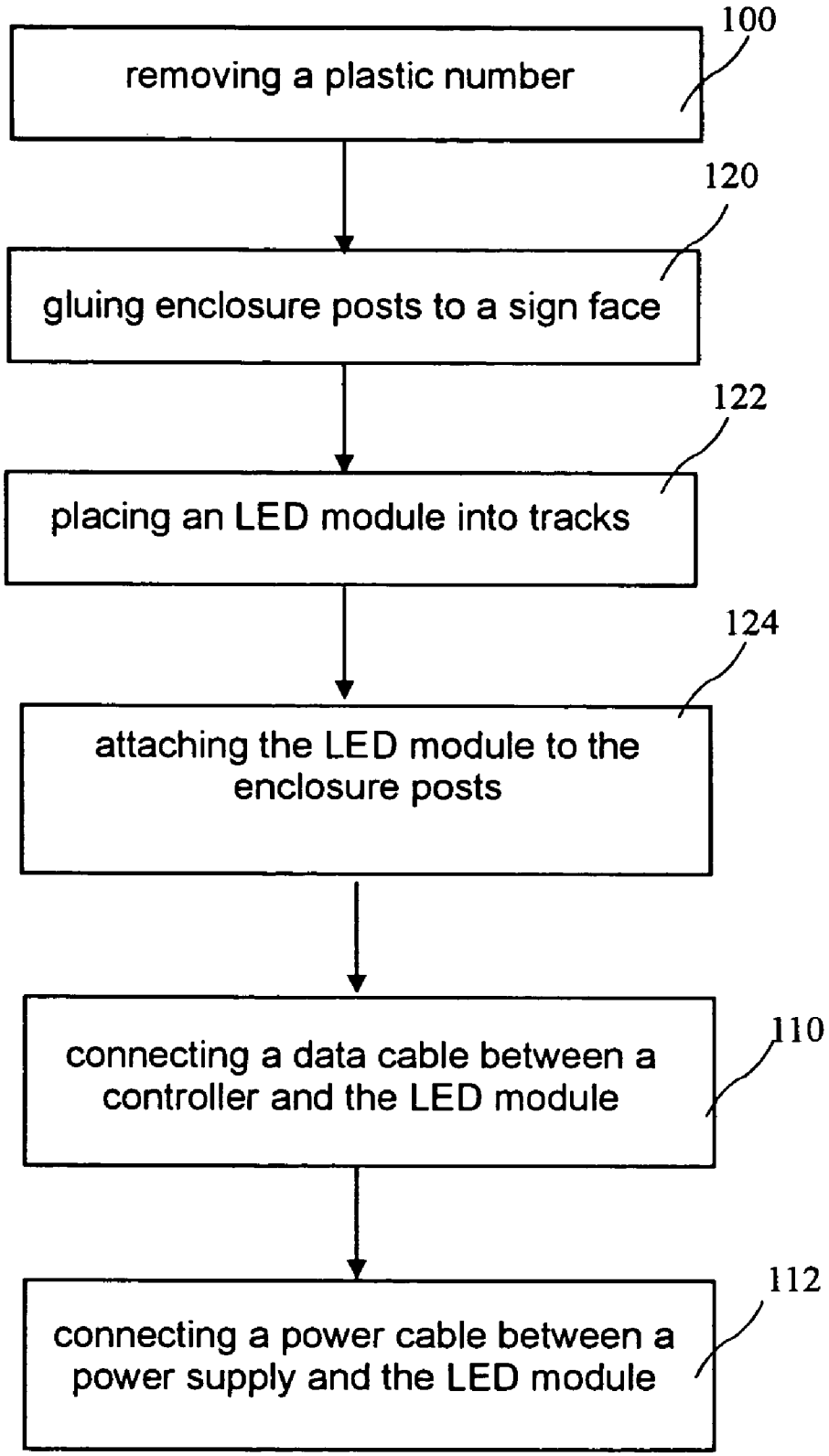

FIG. 17 is a second method for converting a known sign to an LED module sign.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
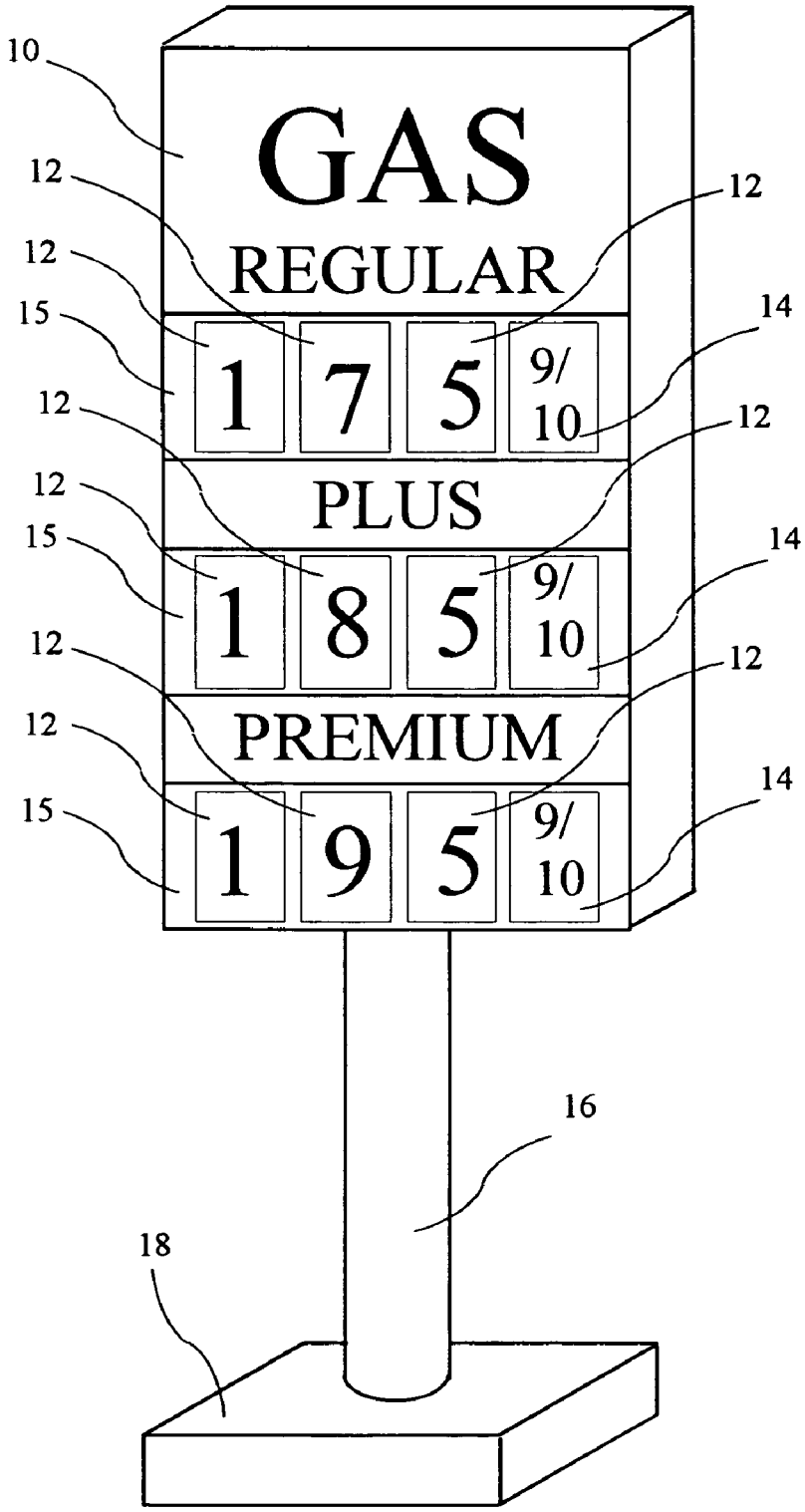
FIG. 1 (Prior Art)
FIG. 1 is a prior art pricing sign.

A known pricing sign 10 as might be used at a gasoline station is shown in FIG. 1. The sign 10 is constructed to allow plastic numerals 12 to be swapped in and out to change a fuel price. Additional fractional numerals 14 reflect typical fuel pricing.

Figure 2A:
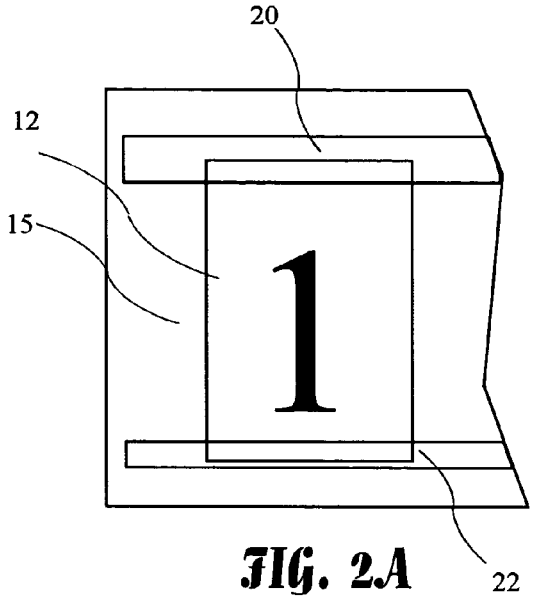
FIG. 2A (Prior Art)
FIG. 2A depicts a prior art plastic numeral residing in first tracks on a sign face.
Figure 2B:
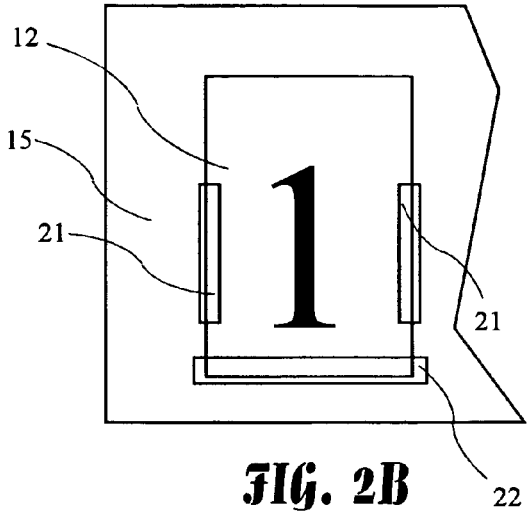
FIG. 2B (Prior Art)
FIG. 2B depicts the prior art plastic numeral residing in second tracks on a sign face.

The numerals 12 generally residing between horizontal upper track 20 and lower track 22 on a sign face (or window) 15 as shown in FIG. 2A, or in vertical tracks 21 and the lower track 22 as shown in FIG. 2B. The sign face 15 is generally transparent which allows light radiated inside the sign 10 to back illuminate the plastic numerals 12 and other information on the sign face 15, for example, fuel types.

Figure 3A:
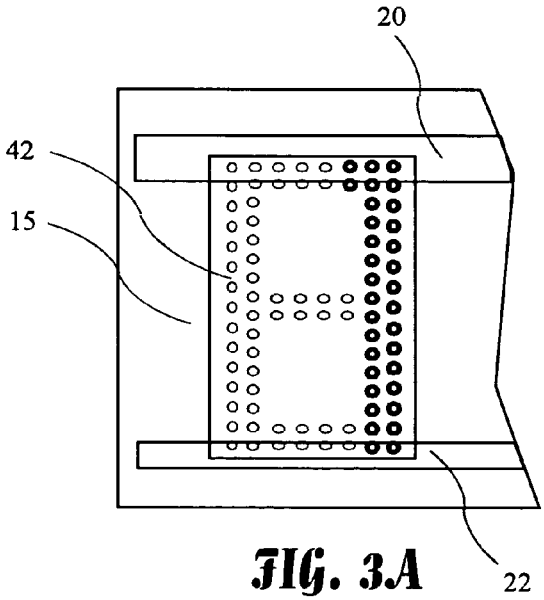
FIG. 3A depicts a single digit Light Emitting Diode (LED) module according to the present invention residing in the first tracks on a sign face.
Figure 3B:
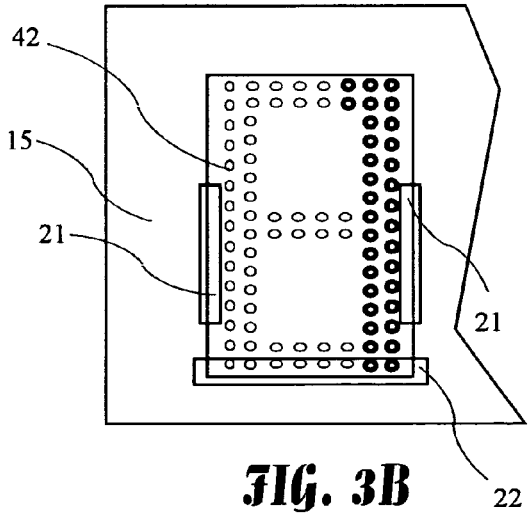
FIG. 3B depicts the LED module residing in the second tracks on a sign face.

A single digit Light Emitting Diode (LED) module 42 according to the present invention is shown residing in the upper track 20 and the lower track 22 in FIG. 3A. The LED module 42 is preferably sized to be inserted into the tracks 20, 22 by first sliding the top of the LED module 42 into the top track 20, and then lowering the LED module 42 into the bottom track 22. The LED module 42 is shown residing in the tracks 21, 22 in FIG. 3B.

Figure 3C:
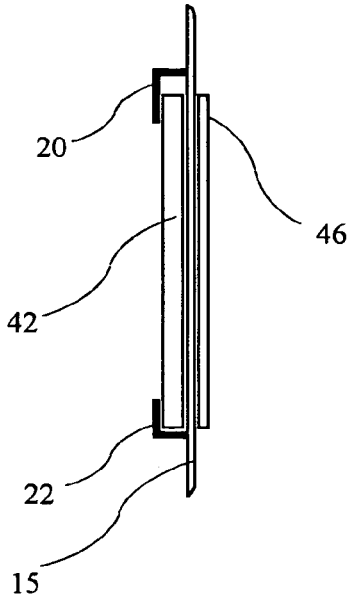
FIG. 3C depicts the a side view of an LED module residing in the first tracks on a sign face.
Figure 3D:
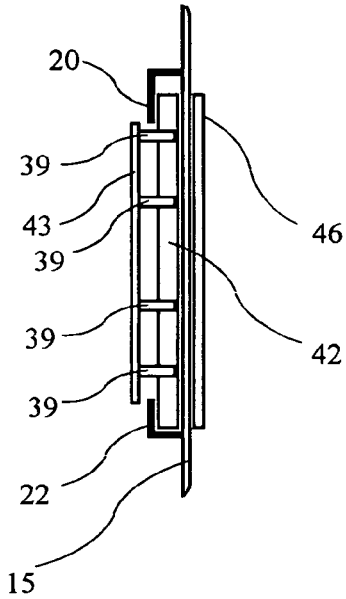
FIG. 3D depicts the a side view of the LED module having a shield, the LED module residing in the first tracks on a sign face.

A side view of the LED module 42 is shown residing in the tracks 20, 22 in FIG. 3C. In a preferred embodiment, the LED module 42 including shield posts 39 provided to facilitate attachment of a transparent shield 43 is shown in FIG. 3D. The shield 43 is advantageous when the LED module 42 is located within reach from the ground, and may be vandalized by spray paint and the like, wherein the shield 43 may easily be cleaned or replaced at low cost.

Figure 4:
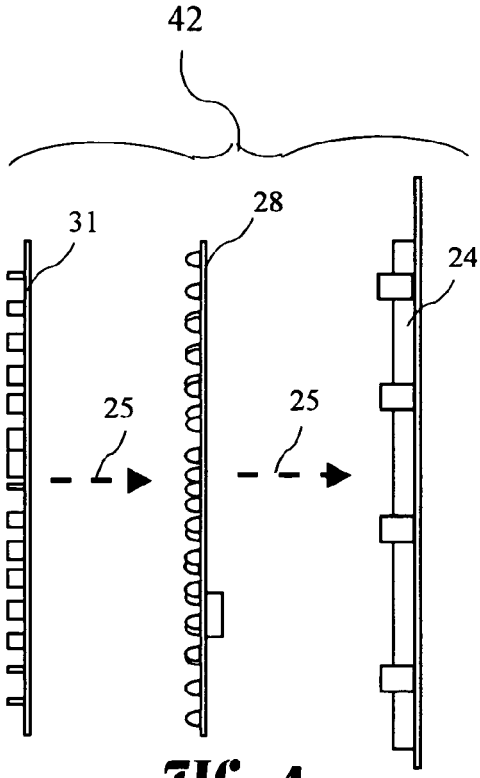
FIG. 4 shows the elements of the LED module.
Figure 4A:
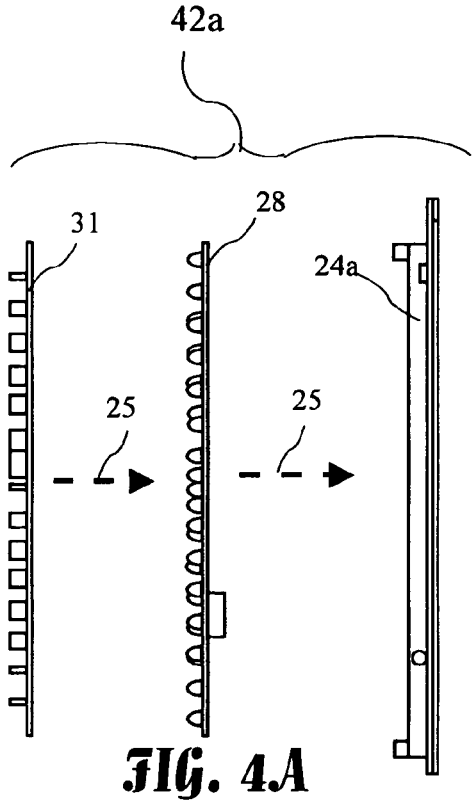
FIG. 4A shows the elements of a second LED module.

The LED module 42 comprises a louver board 31, an LED Printed Circuit Board (PCB) 28, and an enclosure 24 as shown in FIG. 4. The LED module 42 is assembled as indicated by arrows 25. The elements of a second LED module 42*a* comprise the louver board 31, the LED Printed Circuit Board (PCB) 28, and a second LED enclosure 24*a* as shown in FIG. 4*a*.

Figure 5A:
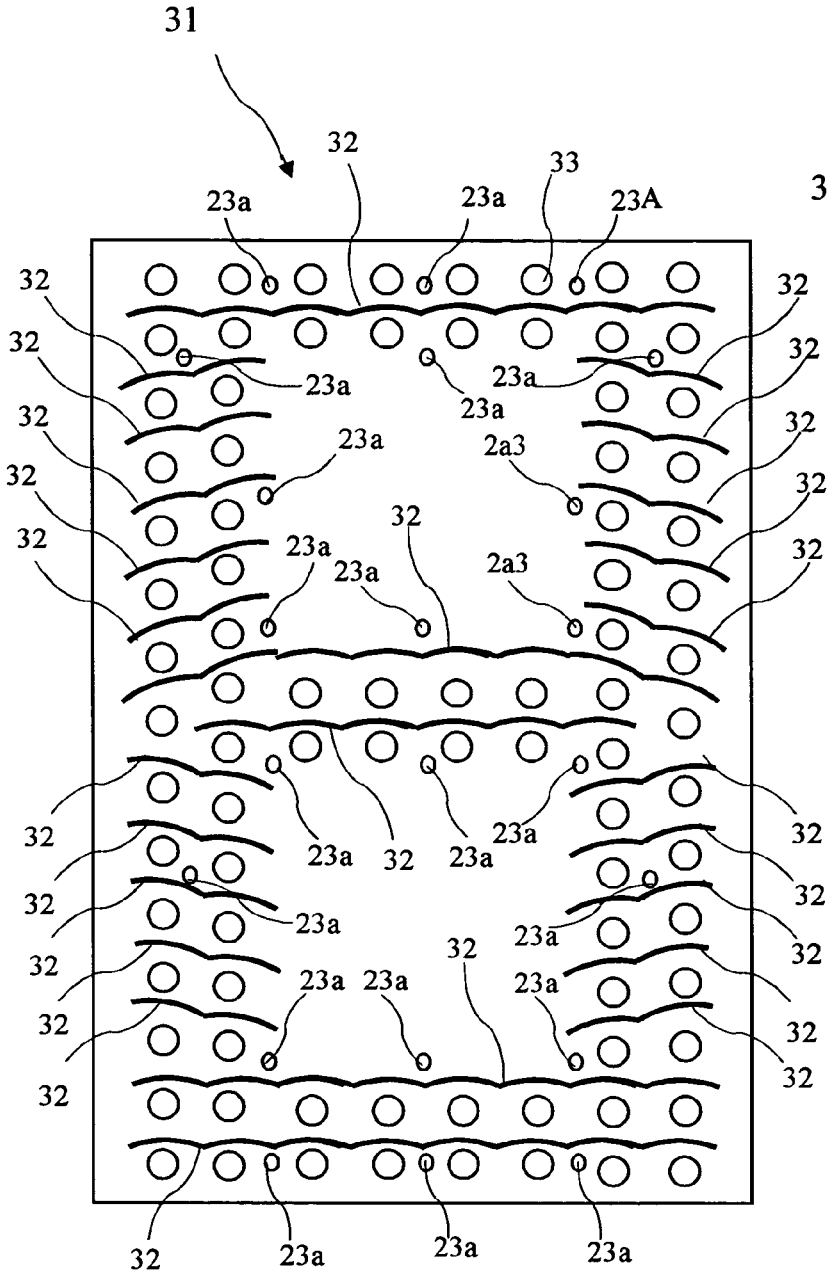
FIG. 5A is a front view of a louver board element of the LED module.
Figure 5B:
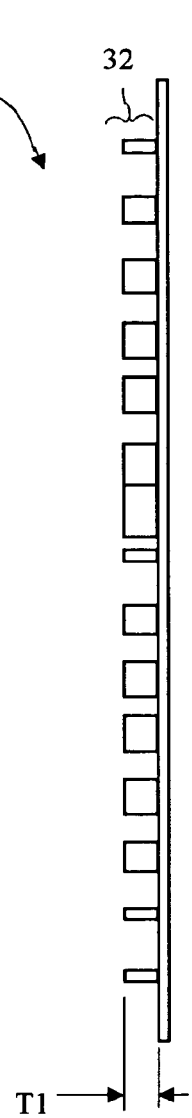
FIG. 5B is a side view of the louver board element of the LED module.

A front view of a louver board 31 is shown in FIG. 5A, and a side view of the louver board 31 is shown in FIG. 5B. The louver board includes a multiplicity of LED holes 33 corresponding to a multiplicity of LEDs 27 (see FIG. 6A). When the LED module 42 is assembled, the LEDs 27 are aligned with the LED holes 33 wherein the LEDs 27 pass through the LED holes 33, protrude into the LED holes 33, or are visible through the LED holes 33. The louver board 31 includes louvers 32 which vertically shade the LEDs 27. One of the louvers 32 preferably resides between each pair of vertically adjacent LED holes 33. The louvers 32 extend a thickness T1 from the louver board 31, which thickness T1 is preferably between approximately 0.25 inches to approximately 0.5 inches, and more preferably approximately 0.25 inches. The louver board 31 is mounted to the enclosure 24 using fasteners passing through first mounting holes 23*a* in the louver board 31 and into second mounting posts 37*b* (see FIG. 7A) projecting from the enclosure 24. Post holes 23*b* are provided in the LED PCB 28 (see FIG. 6A), thereby allowing the mounting posts 37*b* to pass through the LED PCB 28. The mounting holes 23*a* in the louver board 31 may be somewhat different in number and location depending on which LED enclosure 24, 24*a* the louver board 31 is mounted on.

Figure 6A:
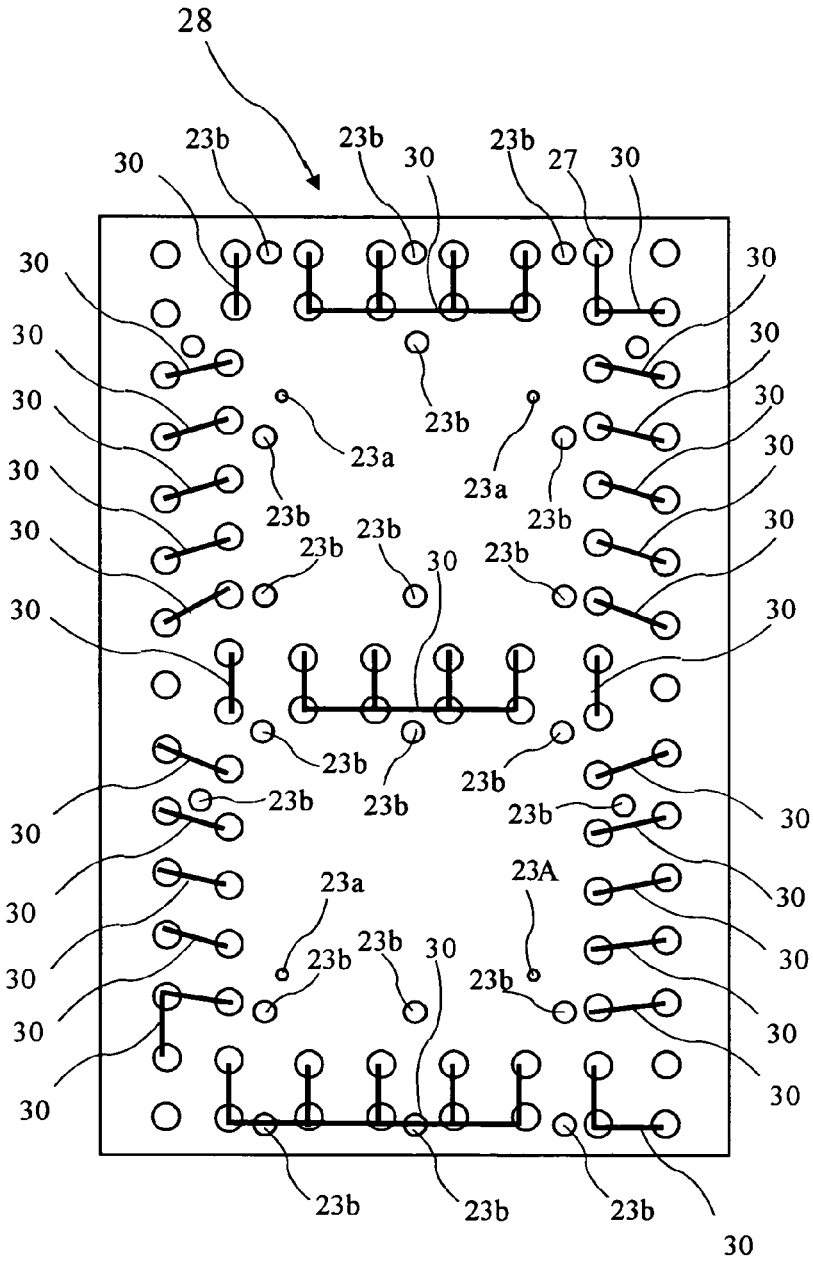
FIG. 6A is a front view of an LED Printed Circuit Board (PCB) element of the LED module.
Figure 6B:
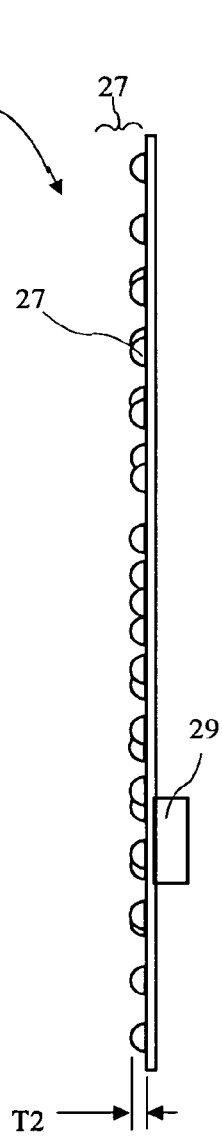
FIG. 6B is a side view of the LED PCB element of the LED module.

A front view of the LED PCB 28 is shown in FIG. 6A, and a side view is shown in FIG. 6B. The LEDs 27 are attached to the LED PCB 28, and the LEDs 27 are selectively electrically connected by electrical connections 30 to minimize the number of separate LED circuits required to form the desired numerals, thereby forming LED segments. The number of LED segments is preferably between seven segment (least expensive) and forty segments (for large signs). More preferably, twenty three LED segments are used. The actual number of LEDs 27 depends on the size of the LED module 42 and details of the numerals desired to be depicted, and larger LED modules 42 will generally have a greater number of LEDs. Preferably, the LEDs 27 comprise a column of fifteen LEDs on each edge of the LED PCB 28, and columns of sixteen LEDs next to the columns of 15 LEDs. Two rows of four LEDs 27 each fit between the columns at the top, center, and bottom of the LED PCB 28. Thus composed, the LEDs 27 form a square cornered "8".

The LED PCB 28 further includes mounting holes 23*a* provided to mount the LED PCB 28 to the enclosure 24 using fasteners passing through the mounting holes 23*a* and into first mounting posts 37*a* (see FIG. 7A) projecting from the enclosure 24. The LED PCB 28 also includes second mounting holes 23*b* for allowing the second mount posts 37*b* to pass through the LED PCB 28. The LEDs 27 extend a thickness T2 from the LED PCB 28, wherein T2 is preferably approximately 0.1 inches. A connector 29 extends from the rear of the LED PCB 28. The mounting holes 23*b* in the LED PCB 28 may be somewhat different in number and location depending on which LED enclosure 24, 24*a* the LED PCB 28 is mounted on.

Figures 7A, 7B:
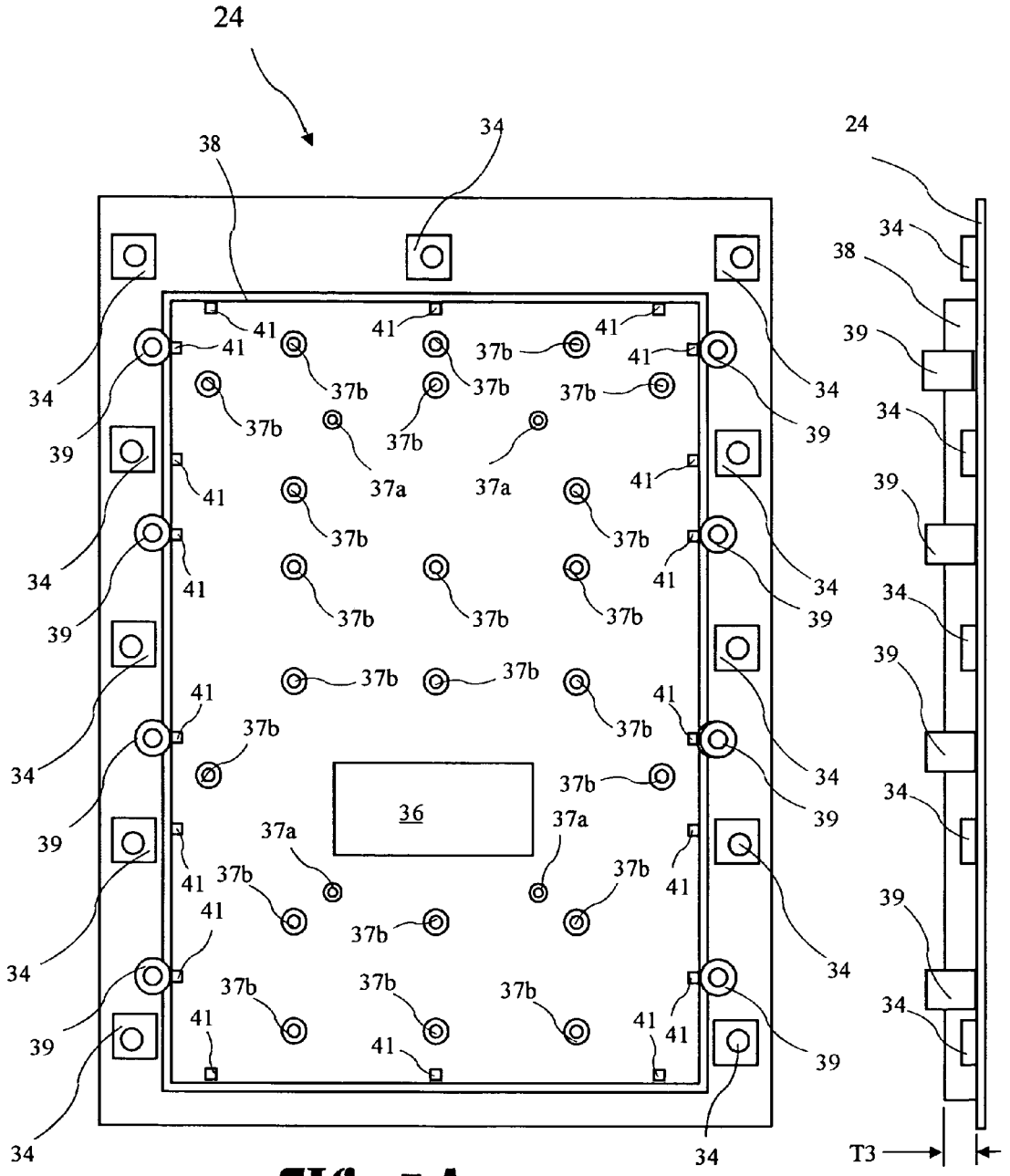
FIG. 7A is a front view of an enclosure element of the LED module.
FIG. 7B is a side view of the enclosure element of the LED module.

A front view of an enclosure 24 is shown in FIG. 7A and a side view of the enclosure 24 is shown in FIG. 7B. The enclosure 24 includes first mounting posts 37*a* for mounting the LED PCB 28 to the enclosure 24, and second mounting posts 37*b* for mounting the louver board 31 to the enclosure 24. A rim 38 has an interior suitable for accepting the LED PCB 29 and/or the louver board 31. The rim 38 extends a third thickness T3 from the surface of the enclosure 24, which thickness T3 is preferably approximately 0.75 inches. A multiplicity of board supports 41 are spaced apart around the interior of the rim 38, which board supports 41 are adapted to support the edge of the LED PCB 29 and/or the louver board 31. An access hole 36 is provided to allow the connector 29 to pass through the enclosure 24. A multiplicity of fastening features 34 are provided around the edge of the enclosure 24 for facilitating mounting the LED module 42 to the sign face 15. Preferably, the fastening features include captive nuts, thereby allowing the LED module 42 and backing plate 46 (see FIGS. 3C and 3D) to be mounted to the sign face 15 using fasteners inserted from inside the sign 10. Generally, the sign face 15 comprises hinged segments, wherein the segments pivot open, providing access to a back side of the sign face 15. Such access allows the LED module 42 to be mounted using fasteners inserted from the inside of the sign 10.

Figure 7C:
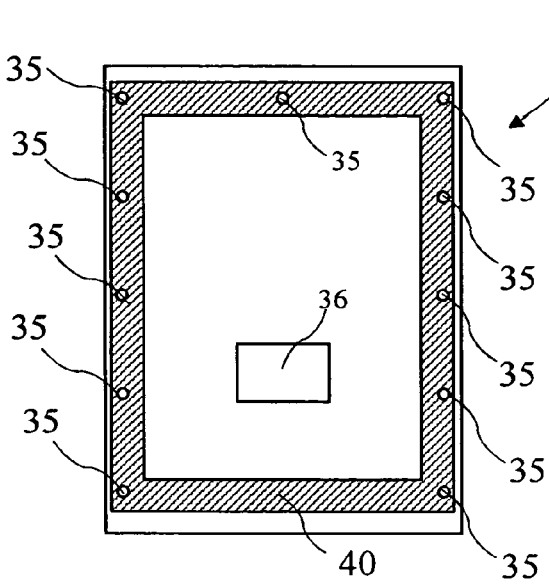
FIG. 7C is a rear view of the enclosure element of the LED module.

A rear view of the enclosure 24 is shown in FIG. 7C. Fastener holes 35 align with fastening features 34. A gasket 40 is provided, which resides on a back mounting surface of the enclosure 24 and has sufficient thickness to compensate for curvature or irregularities in the sign face 15, which gasket thickness is preferably approximately 0.02 inches. The gasket 40 is preferably a double moisture gasket.

Figure 7D:
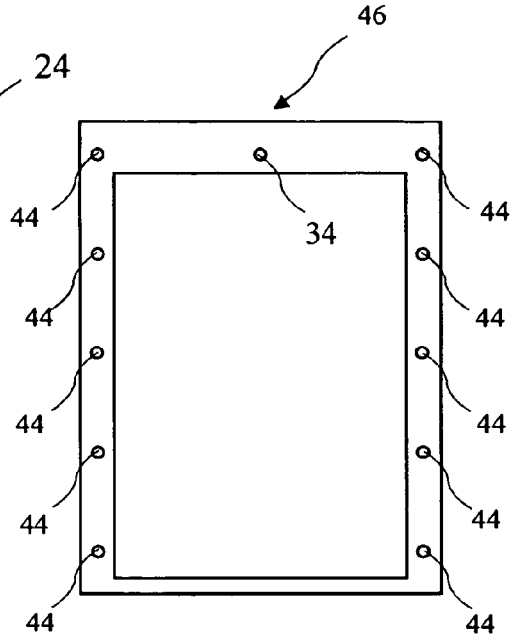
FIG. 7D is a backing plate for cooperating with the LED module to sandwich the sign face.

A backing plate 46 for cooperating with the LED module 42 to sandwich the sign face 15 is shown in FIG. 7D. The backing plate 46 includes second fastener holes 44 positioned to cooperate with fastener holes 35 in the enclosure 24.

Figure 8A:
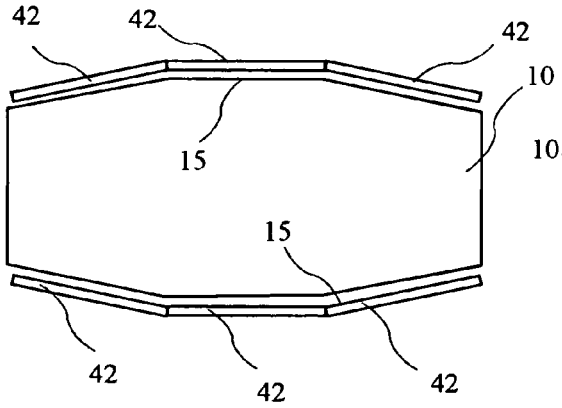
FIG. 8A shows a top view of the LED modules mounted on an outwardly facing side of the sign face.
Figure 8B:
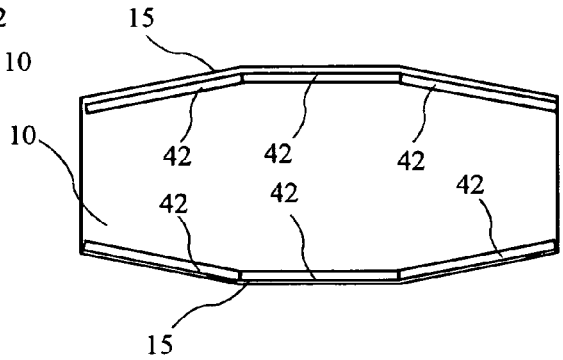
FIG. 8B shows a top view of the LED modules mounted inside the sign.

A top view of several of the LED modules 42 mounted on an outwardly facing side (or outer surface) of the sign face 15 is shown in FIG. 8A, and a top view of several of the LED modules 42 mounted inside the sign face 15 is shown in FIG. 8B. The LED modules 42 are preferably mounted outside the sign face 15 to allow better heat dissipation, but because the LED modules 42 are constructed as single numeral segment, the LED modules may be mounted inside the sign face 15 without creating a substantial gap between the LEDs and the sign face (or window) and thereby avoid diffusion of the light radiated by the LEDs.

Figure 8C:
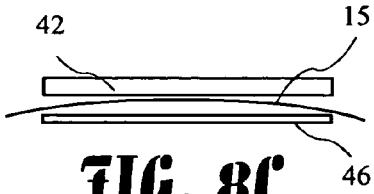
FIG. 8C is a detailed top view of a curved segment of the sign face sandwiched between the LED module and the backing plate.
Figure 8D:
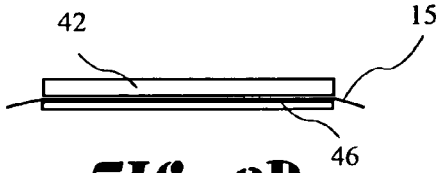
FIG. 8D is a detailed top view of a previously curved segment of the sign face sandwiched between an LED module and backing plate, wherein the previously curved segment of the sign face is substantially straightened.

In some cases, the sign face 15 may have some degree of curvature. A detailed top view of a curved segment of a sign face 15 residing between the LED module 15 and the backing plate 46 is shown in FIG. 8C. A second detailed top view of the previously curved segment of a sign face 15 now sandwiched between an LED module 42 and backing plate 46 is shown in FIG. 8D. The backing plate 46 has been tightened against the LED module 42 and the segment of the sign face 15 between the backing plate 46 and LED module 42 is thereby straightened. Straightening of the curved sign face 15 also results when the LED module 42 is inside the sign 10 and the backing plate 46 is on an outside surface of the sign face 15.

Figure 9C:
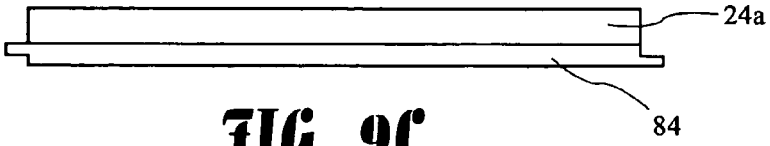
FIG. 9C is a top view of the second embodiment of the LED enclosure.
Figure 9A:
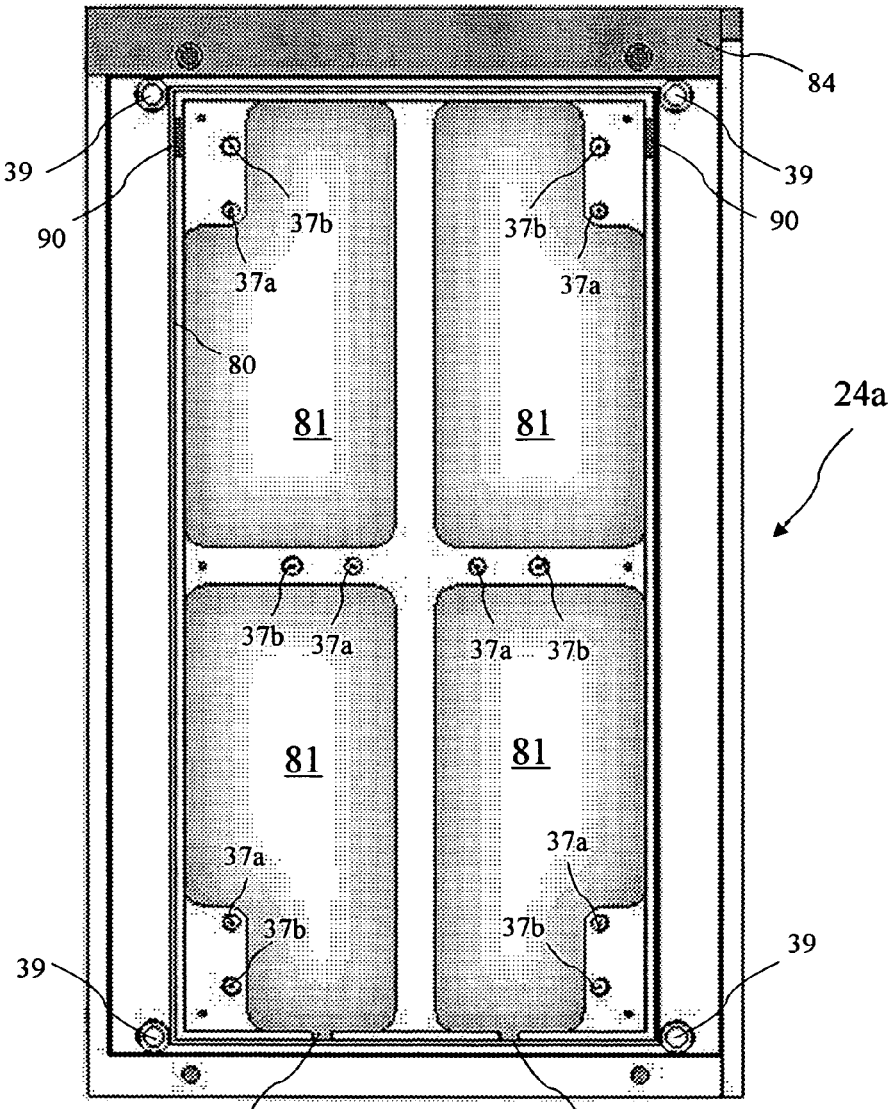
FIG. 9A is a front view of a second embodiment of the LED enclosure.
Figure 9B:
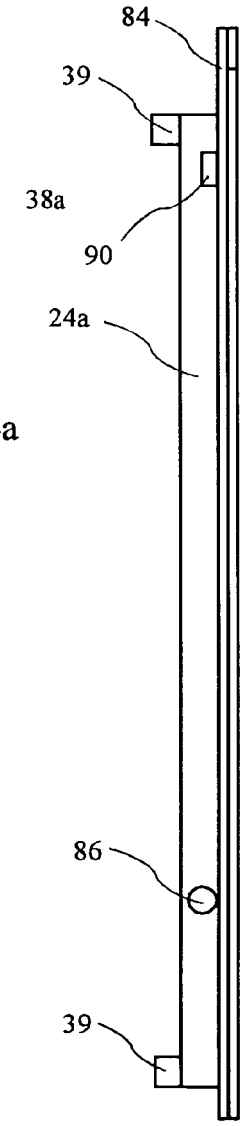
FIG. 9B is a side view of the second embodiment of the LED enclosure.

A front view of a second LED enclosure 24*a* which is part of the second LED module 42*a* (see FIG. 4A) is shown in FIG. 9A, a side view in FIG. 9B, and a top view in FIG. 9C. The LED enclosure 24*a* includes four shield posts for facilitating mounting a shield 43 (see FIG. 3D) over the second LED module 42*a*, six first mounting posts 37*a* for mounting an LED PCB 28 (see FIG. 6A), and six second mounting posts 37*b* for mounting a louver board 31 (see FIG. 5A) to the LED enclosure 24*a*. The shield 43, LED PCB 28, and louver board 31 are attached to the LED enclosure 24*a* in a similar manner as they are attached to the LED enclosure 24, however the position and number of mounting holes 23*a*, 23*b* are adapted to match the mounting posts 37*a*, 37*b* location and number shown for the LED enclosure 24*a*. The LED PCB 28 resides against a seat 80 on the LED enclosure 24*a*. The number of shield posts, mounting posts may be changed for convenience, and an LED module having a different number of shield posts or mounting posts is intended to come within the scope of the present invention.

Four openings 81 in the LED enclosure 24, residing behind the LED PCB 28 mounting position, open approximately 85 percent of the area behind the LED PCB 28. The openings 81 are similar in shape, and reside in two rows of two openings 81. Bottom (or first) openings 88 near the bottom of the LED enclosure 24*a* allow air to enter the second LED module 42*a*, and top (or second) openings 90 near the top of the LED enclosure 24*a* allow hot air to escape the LED module 42*a*. The top openings 90 are preferably on sides of the LED module 42*a* near the top of the LED module 42*a*. Wire passages 86 are provided in each side of the LED enclosure 24*a* to allow wiring to pass between second LED modules 42*a* to thus avoid creating holes in the sign face 15 (see FIG. 1).

A top piece 84 is attached to the top of the LED enclosure 24*a*. The top piece 84 is preferably snapped into place, and is removable, but may be held by screws or similar fasteners, pop rivets, glue, or the like. The top piece 84 is provided so that a small number of LED modules may be adapted to fit the vertical space provided by a variety of existing signs. The Top pieces 81 are preferably provided in approximately ¼ inch increments of height.

Figures 9D, 9E, 9F, 9G:
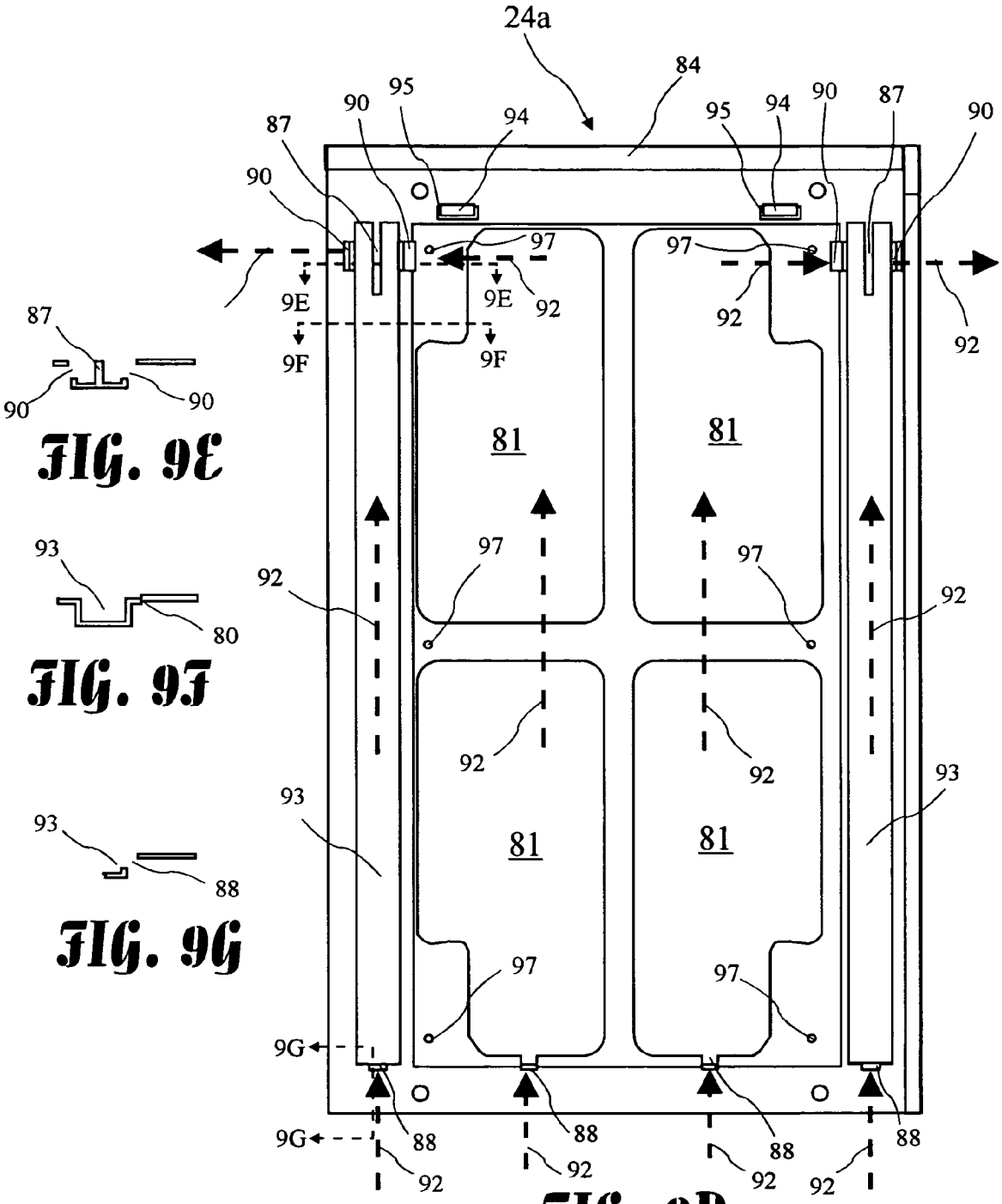
FIG. 9D is a rear view of the second embodiment of the LED enclosure.
FIG. 9E is a cross-sectional view of a portion of the second embodiment of the LED enclosure taken along line 9E-9E of FIG. 9D.
FIG. 9F is a cross-sectional view of a portion of the second embodiment of the LED enclosure taken along line 9F-9F of FIG. 9D.
FIG. 9G is a cross-sectional view of a portion of the second embodiment of the LED enclosure taken along line 9G-9G of FIG. 9D.

A rear view of the LED enclosure 24*a* is shown in FIG. 9D. Latches 94 attached to the top piece 84 extend through notches 95 in the LED enclosure 24*a* to attach the top piece 84 to the LED enclosure 24*a*. Four bottom openings 88 allow an air flow 92 to enter the second LED module 42*a*. A portion of the air flow 92 enters bottom openings 88 near the bottom corners of the LED enclosure 24*a* and flows upward through channels 93, and out though the side openings 90 near the top of the LED enclosure 24*a*. Another portion of the air flow 92 flows upward through a main center portion of the second LED module 42*a* to cool the LEDs 27 (see FIGS. 6A, 6B), and out though the side openings 90 near the top of the LED enclosure 24*a*. Baffles 87 at the tops of the channels 93 prevent water from entering the LED enclosure 24*a* through the side openings 90, wherein the water drains through the channels 93.

A cross-sectional view of a portion of the channel 93 of the LED enclosure 24*a* taken along line 9E-9E of FIG. 9D is shown in FIG. 9E. Side openings 90 are separated by the baffle 87, thereby preventing water from entering the interior of the second LED module 42*a*. A second cross-sectional view of a portion of the channel 93 of the LED enclosure 24*a* taken along line 9F-9F of FIG. 9D is shown in FIG. 9F, showing the channel 93 and the seat 80. A third cross-sectional view of a portion of a bottom end portion of the channel 93 of the LED enclosure 24*a* taken along line 9G-9G of FIG. 9D is shown in FIG. 9G, showing a cross-section of the bottom opening 88.

Figure 9K:
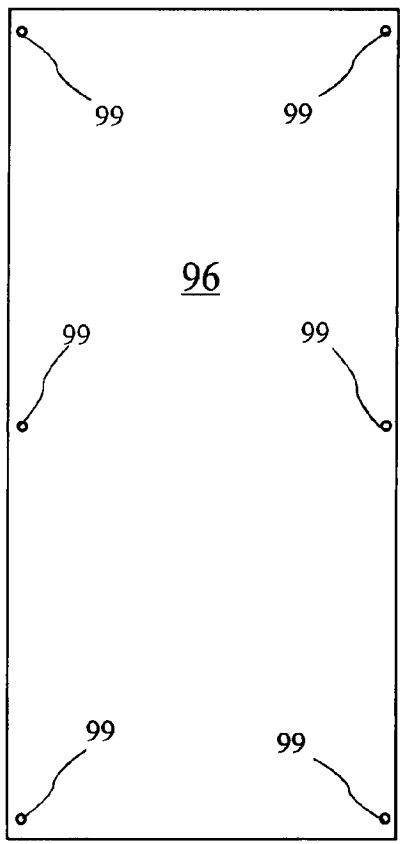
FIG. 9K is the back cover.
Figure 9J:
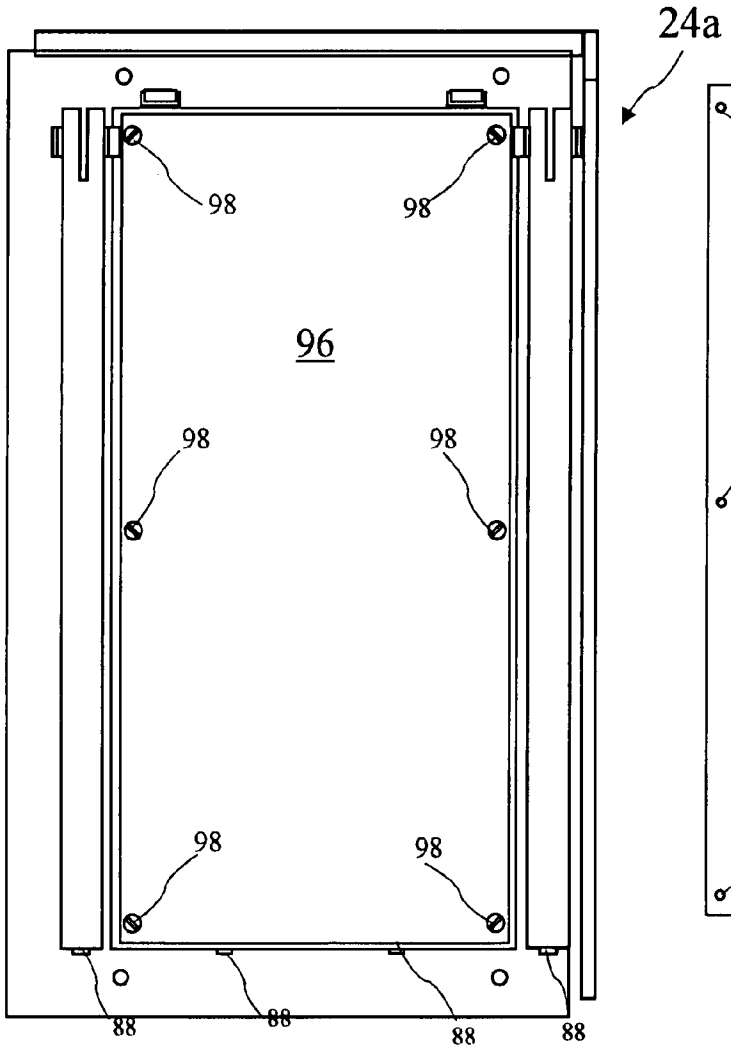
FIG. 9J is a rear view of the second embodiment of the second embodiment of the LED enclosure with a back cover in place.
Figure 9H:
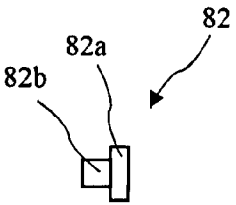
FIG. 9H is a side view of a post used to mount the second embodiment of the LED enclosure to a sign face.
Figure 9I:
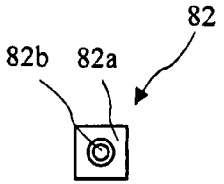
FIG. 9I is a front view of the post used to mount the second embodiment of the LED enclosure to a sign face.

A side view of an enclosure post 82 used to mount the LED enclosure 24*a* to the sign face 15 is shown in FIG. 9H, and a front view of the enclosure post 82 is shown in FIG. 9I. The enclosure post 82 has a square base 82*a* which may be glued to the sign face 15, and a cylindrical portion 82*b* which extends away from the sign face 15. The LED enclosure 24*a* in mounted by aligning the channels 93 with the enclosure posts 82, and inserting screws through the LED enclosure into the enclosures posts. The cylindrical portions 82*b* are smaller than the width of the channels 93, thereby allowing the air flow 92, or a water flow, to pass the cylindrical portions 82*b* when the LED enclosure 24*a* is attached to the sign face 15. The enclosure posts 82 are preferably made from an acrylic material. Other methods of attaching the LED module 24*a* to the sign face 15 may include hooks, catches, and the like, and an LED module attached to a sign face using any of these types of fasteners in intended to come within the scope of the present invention. It is preferred that the mounting method does not require breeching the sign face 15.

A rear view of the second embodiment of the LED enclosure 24*a* with a back cover 96 in place is shown in FIG. 9J, and the back cover alone is shown in FIG. 9K. The back cover 96 is attached to the LED enclosure 24*a* using back cover screws 98 passing through screw holes 99 into cover attachment points 97 (see FIG. 9D). The back cover 96 may be removed to adjust the LED brightness and to make electrical connections. The screws 98 are preferably recessed into the back cover 96.

Figure 10:
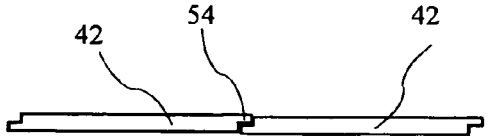
FIG. 10 shows a tongue and groove cooperation of adjacent LED modules.

A preferred tongue and groove 54 cooperation of adjacent LED modules 42 is shown in FIG. 10. Because a light source preferably resides inside the sign 10, light leaks between adjacent LED modules 42 might result from the absence of an overlap of the LED modules 42. The LED enclosures 24, 24*a* preferably include a tongue on one side, and a cooperating groove on the opposite side.

Figure 11:
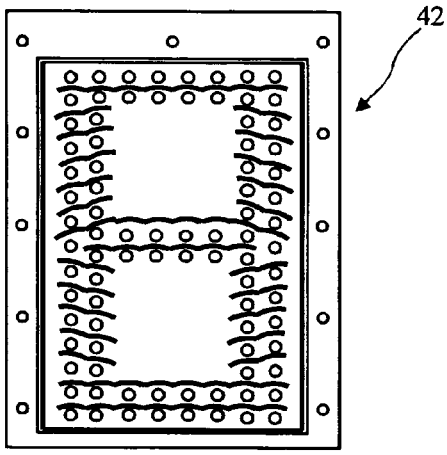
FIG. 11 shows a front view of the LED module.
Figure 11A:
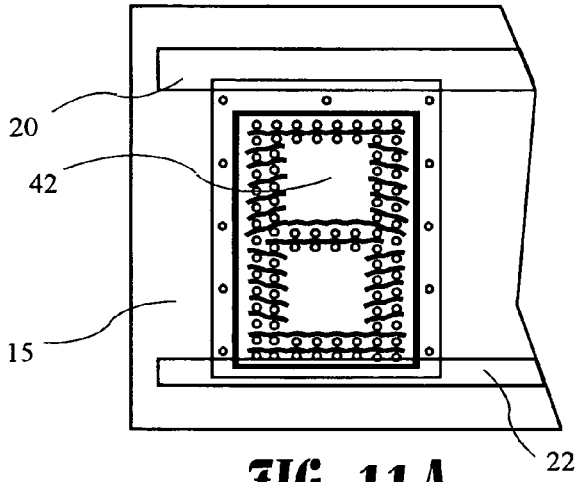

A front view of the LED module 42 alone, and a front view of the LED module 42 attached to a sign face 15 is shown for comparison in FIGS. 11 and 11A.

The preferred arrangement of LEDs 27 with the LEDs off is shown in FIG. 12. LED numerals 26*a*-26*j* representing ten Arabic numerals "1", "2", "3", "4", "5", "6", "7", "8", "9", and "0" are shown in FIGS. 12A-12J. Generally, fuel prices also include a fractional amount "9/10" which may be represented by an LED fractional numeral 26*k* as shown in FIG. 12K. In cases where a decimal point is desired or required by law, a narrow decimal point module 26I may be used to provide an LED decimal point as shown in FIG. 13. A sign 10 having prices represented by LED numerals according to the present invention is shown in FIG. 14.

An interior view of the sign 10 having LED modules 42 according to the present invention is shown in FIG. 15A. Power cables 66 provide a power signal to a power supply 64, and distribute power to the connectors 29 on the LED modules 42, LED light sources 74, a fan 76 connected to the power supply 64 by a fan cable 77, and/or to a heater 78 connected to the power supply 64 by a heater cable 79. Data cables 62 provide price (or other) data to a controller 60, and from the controller 60 to the connectors 29 on the LED modules 42. The power cables 64 and the data cables 62 are preferably connected daisy chain fashion between the connectors 29. A dimmer sensor 58 senses ambient light, and sends a dimmer signal over a dimmer cable 56 to the controller 60. Preferably, four LED intensity levels are provided to adjust the LED intensity to ambient light levels, and the light sources 74 may be turned on or off based on the sensor 58 data. An input sensor 68 receives price (or other) information from a Radio Frequency (RF), infrared, or any wireless signal type, and provides a data signal to the controller 60 through a second data cable 70. A preferred data cable for carrying data signals to the sign 10 is a phone wire.

A side view of the sign 10 converted to an LED sign using the second LED modules 42*a* is shown in FIG. 15B. The second LED modules 42*a* are mounted to the sign face 15 using the enclosure posts 82 (see FIGS. 9H, 9I), and the sign face 15 is not breached. Further, the data cable 62 and the power cable 66 exit the sign at a cable exit 67 preferably on the side of the sign and do not breach the sigh face 15 (see FIG. 14). The cable 62, 66 thus do not breach the sign face 15. Other aspects of a converted sign using the second LED modules 42*a* is similar to a sign converted using the first LED modules 42.

A first method for converting a known sign to an LED sign is described in FIG. 16. The method comprises the steps of mounting at least one LED module to the sign, comprising the steps of removing a plastic number at 100, drilling mounting holes in a face at pre-defined locations at 102, placing an LED module into tracks on an outside surface of the face at 104, positioning a backing plate opposite the LED module against an inside surface of the face at 106, and sandwiching the face between the LED module and the backing plate using fasteners passing through the backing plate, through the face, and into the LED module at 108. Steps 100-108 are repeated for each LED module. Data is provided to each LED module by connecting a data cable between a controller and the LED module at step 110, and power is provided to the LED modules by connecting a power cable between a power supply and the LED module at step 112. The method may further include connecting the data cable between a controller and the LED modules in a daisy chain fashion. Drilling the mounting holes may be facilitated by using a template to determine where to drill the holes.

A second method for converting a known sign to an LED sign is described in FIG. 17. The method comprises the steps of mounting at least one second LED module 42*a* to the sign, comprising the steps of removing a plastic number at 100, gluing enclosure posts to the sign face at step 120, placing an LED module into the tracks at step 122, and attaching the LED module to the enclosure posts at step 124. Steps 100, 120-124 are repeated for each LED module. A data cable is connected between a controller inside the sign and the second LED module 42*a* by running the data cable out of a side of the sign near the top of the sign, and down the outside of the sign, without breaching the sign face 15, at step 110. A power cable is connected between a power supply and the second LED module 42*a* in the same manner as the data cable is connects, at step 112.

While the invention herein disclosed has been described by means of specific embodiments and applications thereof, numerous modifications and variations could be made thereto by those skilled in the art without departing from the scope of the invention set forth in the claims.

I claim:

1. A pricing sign including Light Emitting Diode (LED) numerals, the sign comprising:

at least one face; and a multiplicity of single digit LED modules, each having a multiplicity of LEDs, wherein a subset of the LEDs may be energized to represent a selectable one of ten Arabic numerals, wherein the LED modules include a tongue on one side and a groove on an opposite side, wherein the tongues and grooves of adjacent LED modules cooperate to prevent light from escaping between the adjacent LED modules; and wherein each LED module is mounted to the face in an arrangement allowing representation of a price.

2. The pricing sign of claim 1, wherein the at least one face includes an outer surface, and wherein the LED modules are mounted outwardly facing on the outer surface.

3. The pricing sign of claim 2, wherein the outer surface of the sign includes tracks for holding plastic numbers, wherein the LED modules are sized to fit into the tracks in substantially the same manner as the plastic numbers.

4. The pricing sign of claim 3, wherein:

the tracks comprise an upper track and a lower track; and each LED module includes a top piece, which top pieces adjust the total height of the LED module to fit between the tracks.

5. The pricing sign of claim 2, further including enclosure posts glued to the outer surface of the face, wherein the LED modules are mounted to the face by attaching the LED modules to the enclosure posts.

6. The pricing sign of claim 5, wherein the LED modules are electrically connected by power cables and by data cables, which power cables and data cables do not breech the sign face.

7. The pricing sign of claim 2, wherein the LED modules cooperate with backing plates to sandwich the face, thereby mounting the LED modules to the face.

8. The pricing sign of claim 2, wherein the LED modules are electrically connected by data cables, which data cables do not breech the sign face.

9. The pricing sign of claim 2, wherein the LED modules are electrically connected by power cables, which power cables do not breech the sign face.

10. The pricing sign of claim 2, further including shield posts adapted for mounting a shield over the LEDs of each LED module.

11. The pricing sign of claim 2, wherein each LED module includes first openings near the bottom of the LED module to allow a flow of air to enter the LED module, and second openings near the top of the LED module to allow the flow of air to exit the LED module, thereby cooling the LED modules.

12. The pricing sign of claim 1, wherein the LED modules include louvers vertically shading the LEDs.

13. A method for converting a pricing sign to use Light Emitting Diode (LED) numerals, the method comprising:

removing a plastic number;

mounting at least one LED module to a face of the sign, comprising the steps of:

drilling mounting holes in the face at pre-defined locations;

placing an LED module into tracks on an outside surface of the face;

positioning a backing plate opposite the LED module against an inside surface on the face; and sandwiching the face between the LED module and the backing plate using fasteners passing through the backing plate, through the face, and into the LED module; and connecting a power cable between a power supply and the LED module.

14. A gas station pricing sign converted from a plastic numeral sign to an electronic sign, the converted sign comprising:

a sign face;

tracks on the sign face configured to hold plastic numerals;

Light Emitting Diode (LED) modules residing on the sign face the LED modules comprising:

an enclosure having an enclosure front, and enclosure top, and an enclosure rear, which enclosure is approximately the same height as plastic numerals which were replaced;

an LED Printed Circuit Board (PCB) attached to the enclosure front, wherein each LED PCB includes a multiplicity of LEDs, wherein a subset of the LEDs may be energized to represent a selectable one of ten Arabic numerals;

enclosure posts glued to the sign face and detachably attachable to the enclosure rear; and a top piece attachable to the enclosure top, wherein the top piece may be selected from a multiplicity of top pieces to obtain a vertical dimension of the enclosure and the top piece combination approximately equal to a height of the plastic numerals.

15. The LED module of claim 14, further including a tongue on one side of the LED module and a groove on an opposite side of the LED module, wherein the tongues and the grooves of adjacent LED modules overlap to prevent light from leaking between the adjacent LED modules.

16. The LED module of claim 14, wherein the enclosure includes bottom openings to allow a flow of air to enter the enclosure, and top openings to allow the flow of air to exit the enclosure, thereby cooling the LED module.

17. The LED module of claim 16, wherein the enclosure includes channels between the bottom openings and the top openings to allow the flow of air to circulate upward through the enclosure.

18. A gas station pricing sign converted from a plastic numeral sign to an electronic sign, the converted sign comprising:

a sign face;

tracks on the sign face configured to hold plastic numerals;

Light Emitting Diode (LED) modules residing on the sign face the LED modules comprising:

an enclosure having an enclosure front, and enclosure top, and an enclosure rear, which enclosure is approximately the same height as plastic numerals which were replaced;

an LED Printed Circuit Board (PCB) attached to the enclosure front, wherein each LED PCB includes a multiplicity of LEDs, wherein a subset of the LEDs may be energized to represent a selectable one of ten Arabic numerals;

enclosure posts glued to the sign face and detachably attachable to the enclosure rear;

bottom openings to allow a flow of air to enter the enclosure, and top openings on sides of the enclosure to allow the flow of air to exit the enclosure, thereby cooling the LED module;

channels between the bottom openings and the top openings to allow the flow of air to circulate upward through the enclosure; and baffles at tops of the channels for preventing water from entering the enclosure.

* * * * *